United States Patent [19]

Smith

[11] Patent Number: 5,071,133

[45] Date of Patent: Dec. 10, 1991

[54] BOARD GAME FOR TEACHING BIBLICAL PRINCIPLES

[76] Inventor: Jerry I. Smith, P.O. Box 41191, Houston, Tex. 77241-1191

[21] Appl. No.: 391,868

[22] Filed: Aug. 10, 1989

[51] Int. Cl.[5] ..... A63F 3/00

[52] U.S. Cl. ..... 273/248; 273/240; 273/256; 273/291; 283/49

[58] Field of Search ..... 273/243, 246, 247, 248–254, 273/256

[56] References Cited

U.S. PATENT DOCUMENTS

| | | | |
|---|---|---|---|
| 1,391,333 | 9/1921 | McManus | 273/249 |
| 1,628,073 | 10/1927 | Sousa | 273/246 |
| 3,833,220 | 9/1974 | Schurdell | 273/247 |
| 4,121,823 | 10/1978 | McBride | 273/243 |
| 4,124,214 | 11/1978 | Pavis | 273/249 |
| 4,196,904 | 4/1980 | Bailey | 273/256 |
| 4,201,388 | 5/1980 | Cantelon | 273/251 |

FOREIGN PATENT DOCUMENTS

| | | | |
|---|---|---|---|
| 1396079 | 5/1975 | United Kingdom | 273/256 |

*Primary Examiner*—Benjamin Layno
*Attorney, Agent, or Firm*—David M. Ostfeld

[57] ABSTRACT

A game is disclosed using random movement of playing pieces by players to teach biblical principles. The game includes a board having a playing path divided into several spaces. A playing piece, one for each player, is placed on the "Start" space and oriented to represent religiously "unconverted" players. The playing pieces move counterclockwise along the path in accordance to the roll of the dice. Counterclockwise movement continues until a playing piece lands on a "Sunday" space, at which point the corresponding player throws the dice again. If the number on the dice is even, the player remains "unconverted" and continues to move counterclockwise. If the number on the dice is odd, the playing piece is reversed to indicate that the player is religiously "converted", and moves the playing piece in a clockwise direction for the rest of the game. Property spaces, property deeds and play money provide players the opportunity to invest while moving along the path. The playing path further includes "Danger" spaces. If a player lands on a "Danger" space three times, that player must move to the "Great Exit Space" and move along the interior playing path spaces towards one of two finish spaces. A plurality of peg boards and sticks insertable in the peg board keep track of number of times players land on the "Danger" spaces.

9 Claims, 6 Drawing Sheets

BOARD GAME FOR TEACHING BIBLICAL PRINCIPLES

TECHNICAL FIELD

The invention is a game which is designed to introduce Biblical principles and provide entertainment for participants.

BACKGROUND ART

Numerous board games use dice, have playing pieces which are moved from space to space, have property squares, use money, use cards, have goals which are to be reached and have a process by which the desired end is to be achieved. Among the games which have influenced the invention of Conversion are Monopoly. Parcheesi and Yahtzee. Like many games. Conversion has playing pieces which are moved from space to space: however, the playing pieces are unique in that the pieces are inverted during the game when the player becomes "converted." Conversion, like Monopoly, has property squares which may be purchased. Any player other than the owner of such property must pay a fee each time he lands on such property. The fee is the same for all properties.

Like Monopoly. Conversion involves the use of money. However, there are no payments of paper money. Instead of receiving paper money, the player records on his asset sheet the sum of thirty thousand dollars each time he passes the start position. The "score sheets" are preprinted just like Yahtzee: however, the content and the print are totally different from Yahtzee's score sheets. Conversion also uses sets of cards. Unlike Monopoly which uses two stacks of cards (i.e., Chance and Community Chest). Conversion uses four sets of cards which are: (i) Providence Cards: (ii) Sin Cards; (iii) Blessing Cards; and (iv) Reward Cards. Each stack of cards has scripture verses written on them which are designed to teach and reinforce certain Biblical principles. Unlike Parcheesi which has only a home at the end of its game. Conversion has both a "home," which is called "Eternal Happiness." and an "end of game" for the losers, which is called "Eternal Loss".

In sum, it is the object of this invention to use a board game to teach, while incorporating some elements known in the prior art of board games. Conversion is otherwise new and unique and teaches and reinforces Biblical principles while providing entertainment to the participants.

DISCLOSURE OF THE INVENTION

Conversion comprises an octagon shaped board game with eight spaces on each side of the octagon. The game begins with each of the players throwing dice to determine who is first. The player who rolls the highest number on the dice goes first, and the remaining players take their turn in accordance with their position around the board, going clockwise beginning with the player at the first player's left. Each player has a player piece (or "man") which is first placed on the "Start" place on the board, and as the game progresses, each player's piece is moved from space to space, counterclockwise on the game board. Each player, in his turn, continues to move his player piece counterclockwise in accordance with the number on the throw of dice until landing on a "Sunday" space, at which point the player throws the dice again. If a player throws an even number on the dice, he remains "unconverted" and continues to move the player piece counterclockwise. If the player throws an odd number on the dice, he becomes "converted," inverts his player piece (turns it upside down) to indicate that he is now a "new creature in Christ," throws the dice again, and moves his player piece in a clockwise direction for the rest of the game. Simultaneously, a means is provided by which each player maintains a tally of assets (money and property) accumulated during the game, which tally may increase or decrease in accordance with a variety of rewards and penalties incurred in the course of the game. The winner of the game is the converted player with the highest asset value, which is determined only after all players have entered either "Eternal Happiness" or "Eternal Loss."

Conversion is designed to teach its players sound Biblical principles throughout the duration of the game. These principles are taught by means of the various spaces on the game board and the four sets of cards (i.e. providence cards, sin cards, blessing cards and reward cards) which are an integral part of the game.

BRIEF DESCRIPTION OF DRAWINGS

In order to obtain a complete understanding of the nature and objects of the present invention, reference is made to the following drawings in which like parts are given like numerals, and wherein:

FIG. 1B is a view of the "Asset Sheet." the "End of Life Tally" Sheet for the converted, and the "End of Life Tally" Sheet for the unconverted;

FIG. 1C-1 is an exploded plan view of the top left quadrant of the game board;

FIG. 1C-2 is an exploded plan view of the top right quadrant of the game board;

FIG. 1C-3 is an exploded plan view of the bottom left quadrant of the game board; and FIG. 1C-4 is an exploded plane view of the bottom right quadrant of the game board.

PREFERRED EMBODIMENT FOR CARRYING OUT THE INVENTION

Game Pieces

Figure 1A:
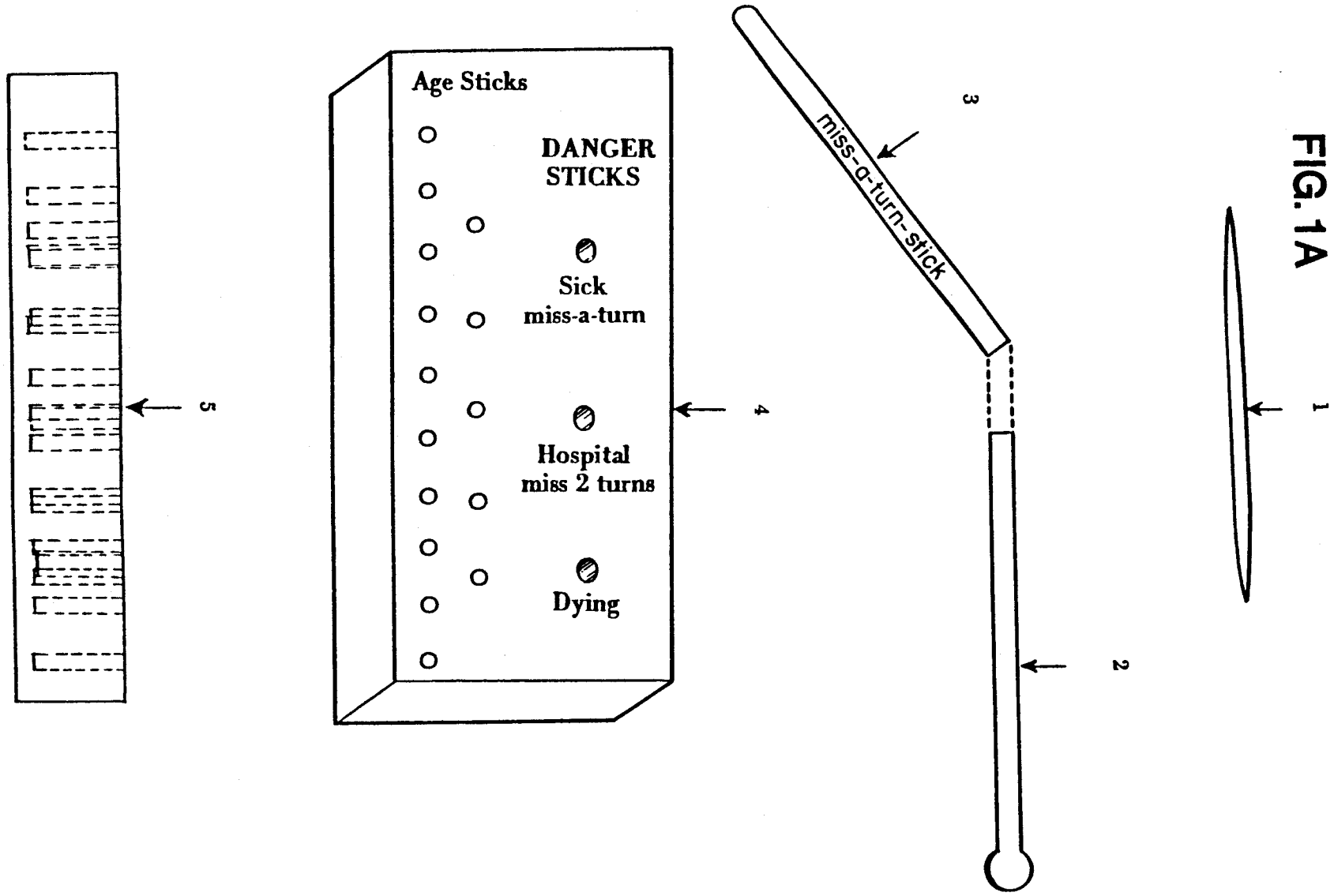
FIG. 1A is a view of: (1) an "age stick," (2) "danger stick", (3) a "miss-a-turn stick," and (4) the peg board, looking at its surface from above.

The board—referring to FIG. 1C, the game board[10] is a square measuring twenty inches by twenty inches and is constructed of ⅛ inch poster board or some similar type of paper (preferably white). upon which is printed an octagon-shaped playing area of various colors as described below. Each side or leg[15] of the octagon contains eight spaces[20], each of which is 2 inches long and seven-eighths of an inch wide, except for the spaces at each end of each leg, which are one and one-half inches wide on the outside edge. The rightward most space of the bottom leg is the "Start" space[25], and moving clockwise from the Start space of the game, spaces ringing the board are designated thusly: "Danger," "Property #1," "Property #2," "Investment Opportunity," "Daily Worship—advance 3 spaces," "Sunday," "Temptation," "Blessing," "Providence," "Deceived by Satan—Go back 3 spaces," "Reward," "Tragedy," "Property #3," "Daily Bible Reading—advance 3 spaces," "Providence," "Temptation," "Reward," "Danger," "Blessing," "Property #4," "Providence," "The Cross—Insurance against Tragedy," "Daily Prayer—advance 3 spaces," "Sunday," "Temptation,"

"Reward." "Offended—lose 1 good reward," "Hardness of Heart—Go back 3 spaces," "Blessing," "Vacation—skip 1 turn," "Property #5," "Daily Witness—advance 3 spaces," "Reward," "Temptation," "Providence," "Danger," "Worldly Concerns—Go back 3 spaces," "Repentance—relief," "Blessing," "Sunday," "Paid Tithes—advance 3 spaces," "Backslidden—lose 1 good reward," "Temptation," "Investment Opportunity," "Property #6," "Deception of Wealth—Go back 3 spaces," "Providence," "Reward," "Blessing," "Mercy—Insurance against Tragedy," "Property #7." "Temptation," "Providence," "Property #8," "Reward," "Faith—rest," "Sunday," "Blessing," "Heart-Felt Praise—advance 3 spaces," "Danger, " "Temptation," "Grace—Insurance against Tragedy," and finally "Danger." In addition, a space designated "The Great Exit"[30] branches upward into the interior of the board from the two "Danger" spaces on each side of the "Start" space. From the "The Great Exit" space, the following additional spaces, each approximately one and three-fourths inches across and seven-eighths inches wide, continue upward into the interior of the board: "Blessing," "Sunday," "Fear of Death—Go back 3 spaces," "Providence," and "Temptation." Continuing upward from the "Temptation" space is "The Parting"[35] space, which is approximately seven-eighths inches wide at the right end and one and one-half inches wide at the left end. Branching leftward from the left end of "The Parting" space are the following additional spaces: "Sunday," "Demon Delusion—Go back 3 spaces," "Providence," "Blessing," "Temptation," "Humility—Go back 3 spaces," "Sunday—Last Chance!," and finally "ETERNAL LOSS,"[40] and branching upward from the top edge of "The Parting" space are the following additional spaces: "Reward," "Spiritual Warfare—Go back 3 spaces," "Yielded to Lordship—advance 3 spaces," "Providence," "Blessing," "Reward," "Temptation," and finally "HOME—ETERNAL HAPPINESS."[45] The chain of spaces going up from the "The Great Exit" space should be not more than two inches from the right side of the inner border of the octagon but curving away to the left as it climbs upward. The chain of spaces from "The Parting" leading to "Eternal Loss" should proceed leftward and then turn downward as illustrated, leaving more room in the interior of the board for dice to be thrown. The Name "CONVERSION" should be at the top right or left side of the game board.

Each space is color coded as follows: "Start"[25] is dark green, "Danger" is red. "Property" is gray. "Investment Opportunity" is flesh. "Advance 3 spaces" is brown. "Sunday" is pink. "Temptation" is yellow. "Blessing" is blue, "Providence" is orange, "Go back 3 spaces" is black, "Reward" is white, "Tragedy" is red and black striped. "Insurance against Tragedy" is violet. "Offended" and "Backslidden" are red, "Vacation" is light green, "Repentance" and "Faith" are lavender, "The Great Exit"[30] is canary and "The Parting"[35] is violet. "Eternal Happiness"[45] is light blue with multiple colors spiraling outward from it, and "Eternal Loss"[40] is enclosed with a black border with multiple colors spiraling inward. Specific colors for spaces are not essential but should match similarly-designated spaces for purposes of recognition. Some spaces contain instructions to help players become familiar with the game or to remind them of the rules without having to refer to the separate written instructions. These include, for example, designating on the "Investment Opportunity" spaces "5,000 (doubles each year)", on the "Tragedy" space "Forfeit cash, property and investments (start over)," on the "Insurance Against Tragedy" space "Collect 1 Token," and on "The Great Exit" space "From here use only 1 dice."

Situated in the interior of the board and three-quarters of an inch to the right of the three leftward-most outside legs of the playing octagon are four rectangles, each approximately 3 inches long and 1 ½ inches wide, designated as follows (from the bottom-most rectangle and moving clockwise): "Sin Cards,"[50] "Providence Cards,"[55] "Blessing Cards,"[60] and "Reward Cards."[65] No two rectangles share the same color, and the lines and corresponding lettering of each rectangle are as follows: "Sin Cards"—yellow, or otherwise the same color as the "Temptation" spaces: "Providence Cards'-'—orange, or otherwise the same color as the "Providence" spaces: "Blessing Cards"—blue, or otherwise the same color as the "Blessing" spaces; and "Reward Cards"—white. The interior of each rectangle is not colored or otherwise shares the same color as the basic color of the board.

A two inch by two inch red square designated "Prison"[70] is drawn near the bottom of the board close to "The Great Exit"[30] space and contains the words: "Prison, turn ends, miss one turn." Beneath and partially overlapping the "Prison" square[70] is the "Bankruptcy Holding Pen,"[75] designated as such and containing the additional words: "Miss-a-turn, then begin at START." The "Bankruptcy Holding Pen" is a circle two inches in diameter and is colored light blue.

Cards—The game contains four (4) sets of cards 50, 55, 60, 65, each card being 3 inches long and 1 ½ inches wide, and each set of cards corresponding to one of the four rectangles described above as "Sin Cards," "Providence Cards," "Blessing Cards," and "Reward Cards." The set of Sin Cards consists of fifty-two (52) cards, the set of Providence Cards consists of forty-seven (47) cards, the set of Blessing Cards consists of seventy-nine (79) cards, and the set of Reward Cards consists of thirty-five (35) cards of which there is a duplicate set so that there are actually seventy (70) cards in the set. The surface of each card of each set of cards is the same color as the rectangle corresponding to that set of cards, except that the set of "Reward Cards" are white, and on the surface of each card of each set of cards is imprinted, in black, as appropriate for that set of cards, the word "Sin," or the word "Providence," or the word "Blessing," or the word "Reward." The underside (face) of each card of each set of cards is white with a legend and a Biblical excerpt imprinted thereon in black, some of which may be repeated on more than one card. The legends are as follows:

1. The "Sin Cards":
a Pride
b. Fear
c. Sowing Disord
d. Self Indulgence
2. The "Providence Cards":
a. God's Silence
b. Sickness
c. Pay Taxes
d. God Cares
3. The "Blessing Cards":
a. Forgiveness
b. Prayer Answered
c. Overcoming Faith
d. Healing 4. The "Reward Cards":
a. Bag of Gold
b. Sack of Straw
c. Precious Jewels
d. Crown of Glory At the commencement of the game, each set of cards is placed as a stack face downward on the rectangle corresponding to that set of cards, and the cards are drawn as explained below in the description of the playing of the game.

Player pieces—Player pieces 90 are one half inch square at the bottom and top and may be shaped convex or concave in the center to distinguish them. One end is flat while the other end has a serrated edge resembling a crown. indicating that the piece (when inverted with the crown on top) has been "converted." The initials "N. C." may be stamped or printed on the end with the crown meaning "New Creature in Christ." Pieces are of various colors for easy identification, and each game is provided with six playing pieces.

Figure 1C:
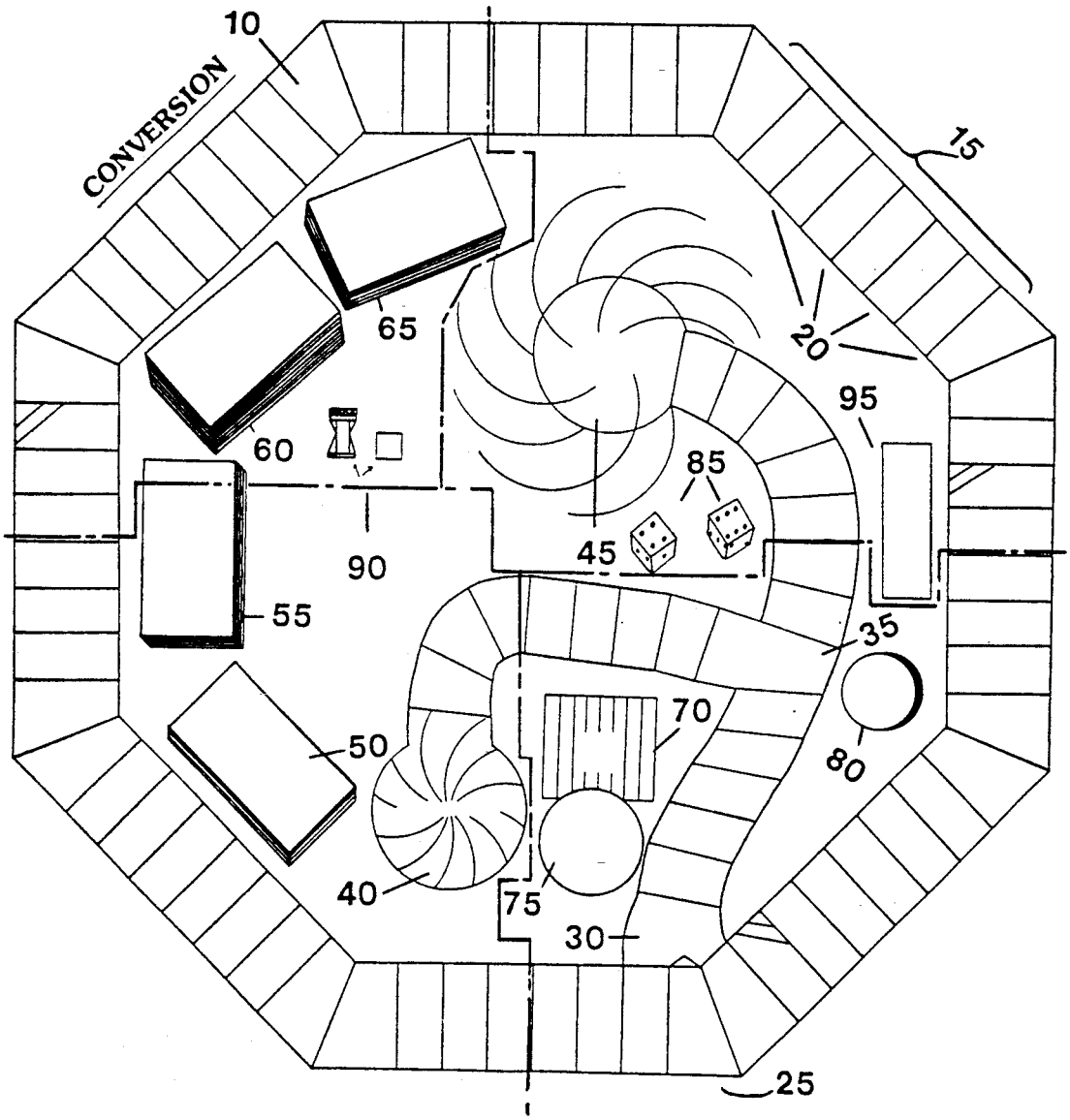
FIG. 1C is a plan view of the game board.
Figures 1, 1C:
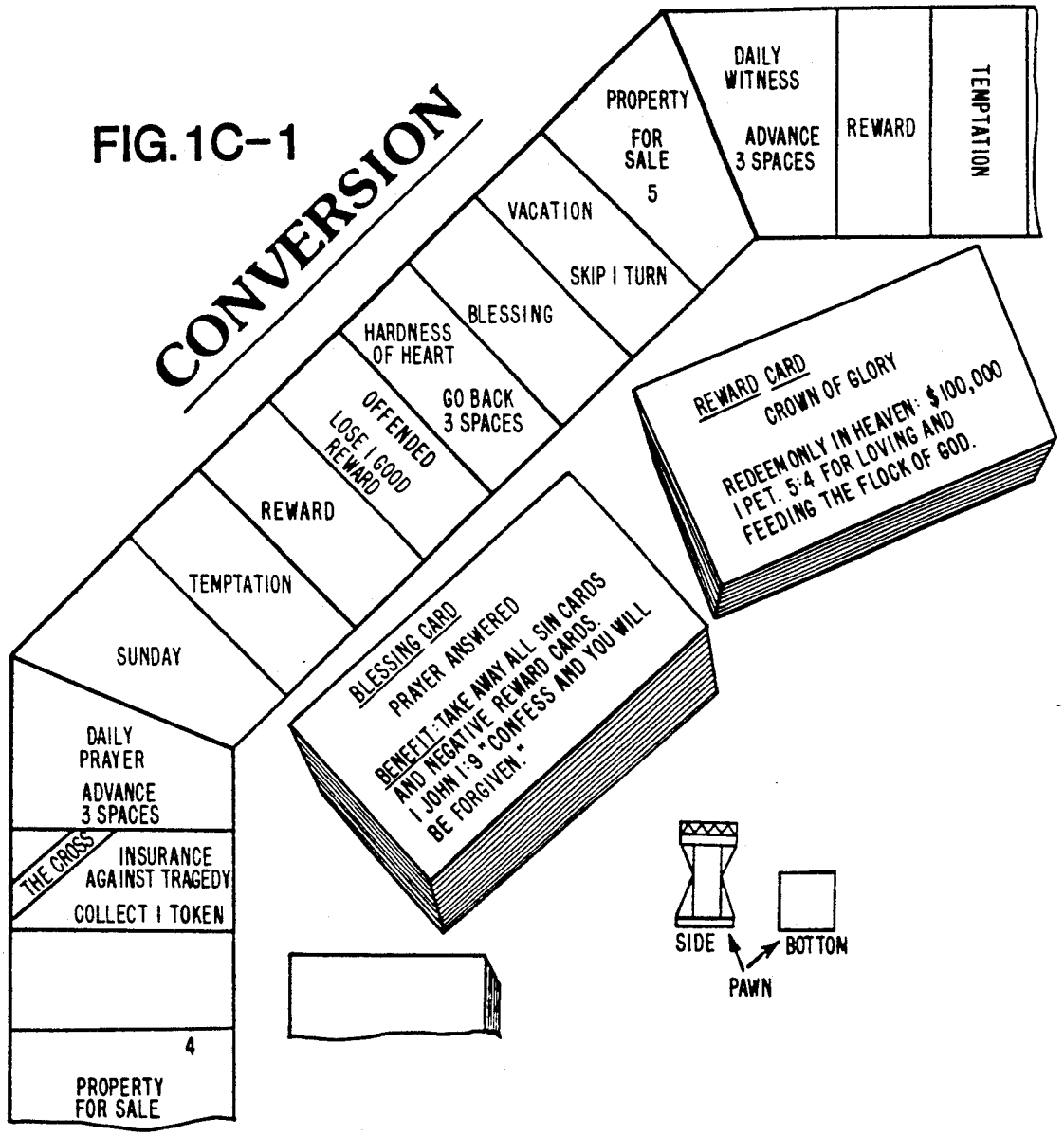
Figures 1, 1C, 2:
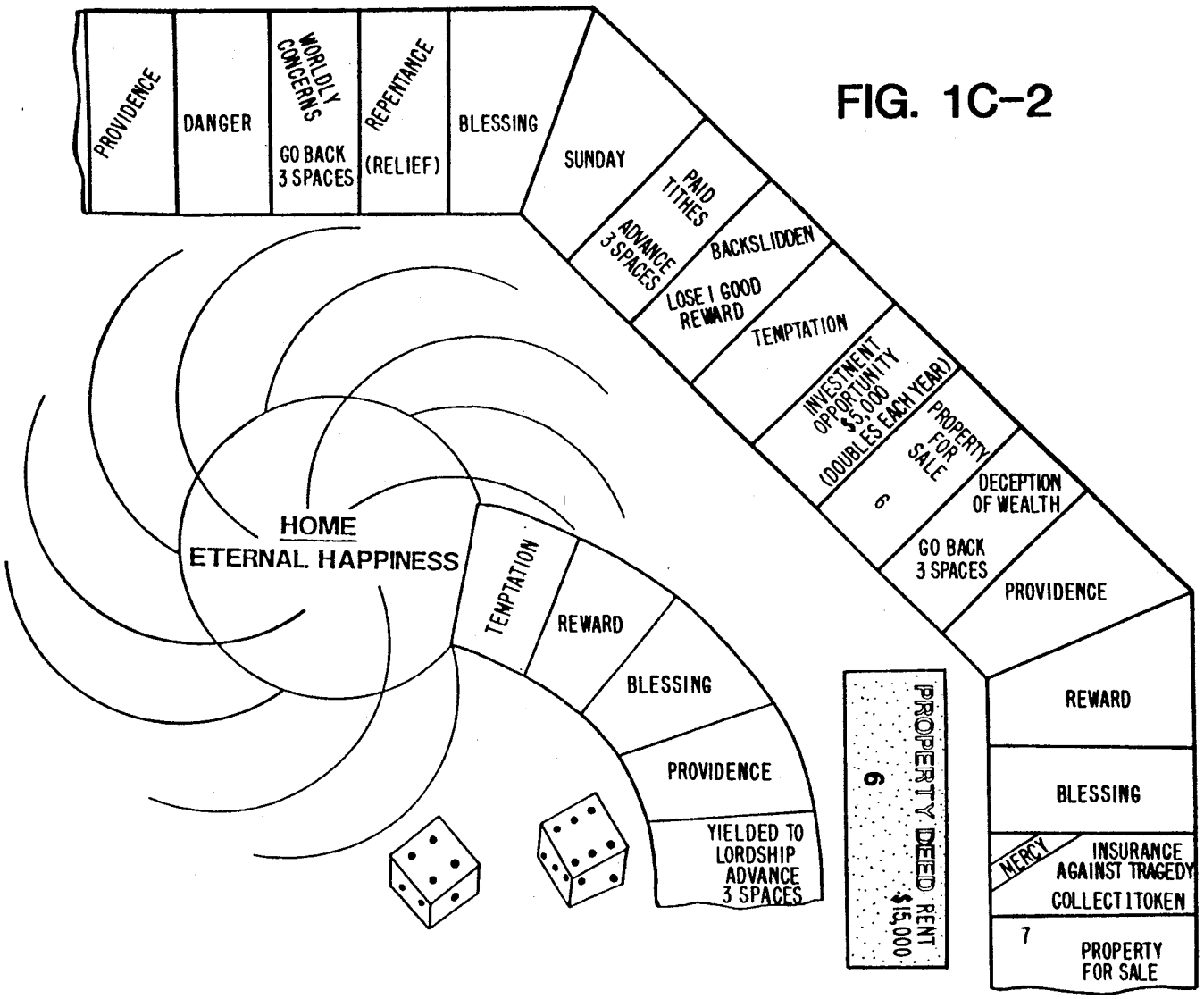
Figures 1, 1C, 2, 3:
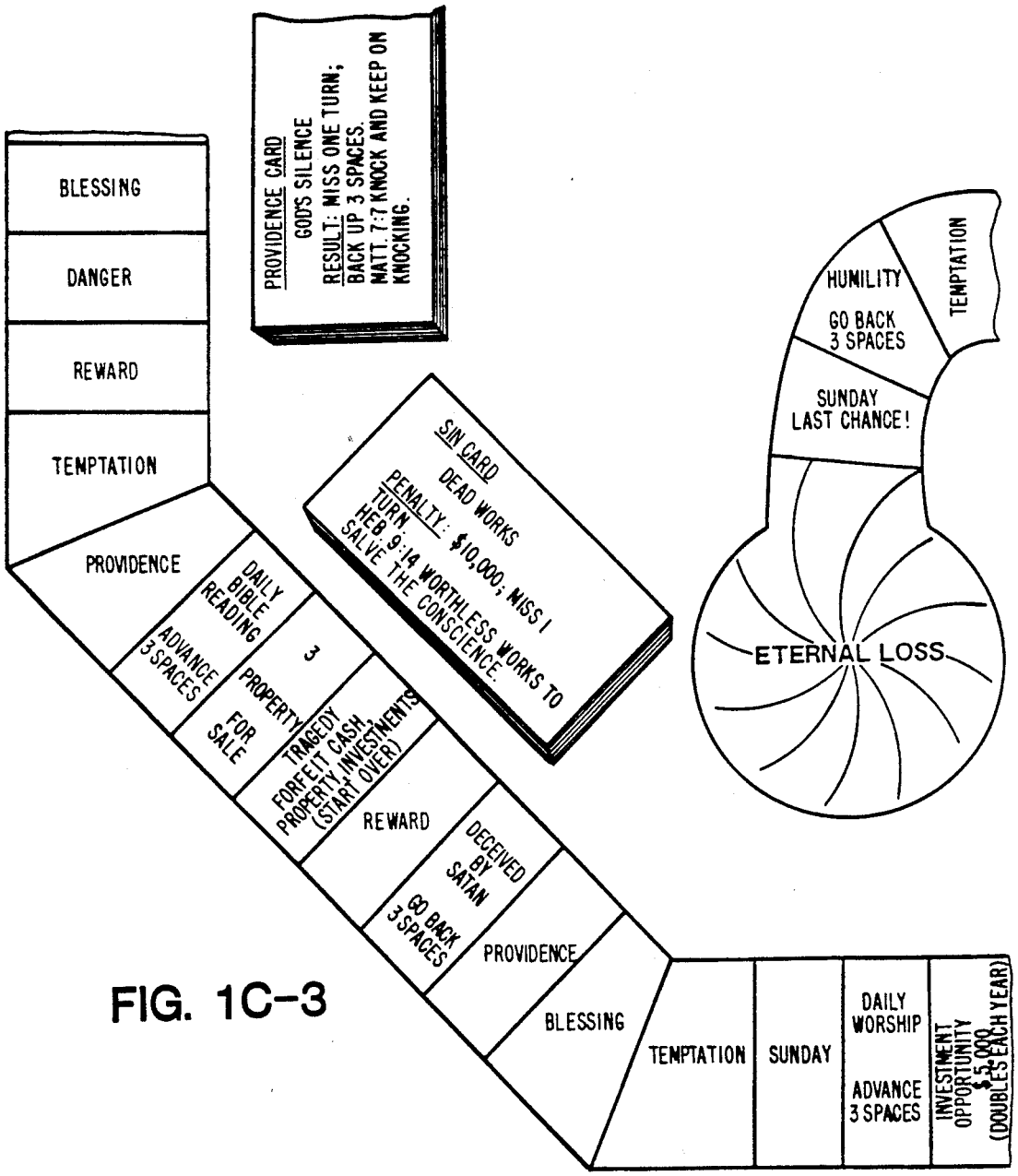
Figures 1, 1C, 2, 3, 4:
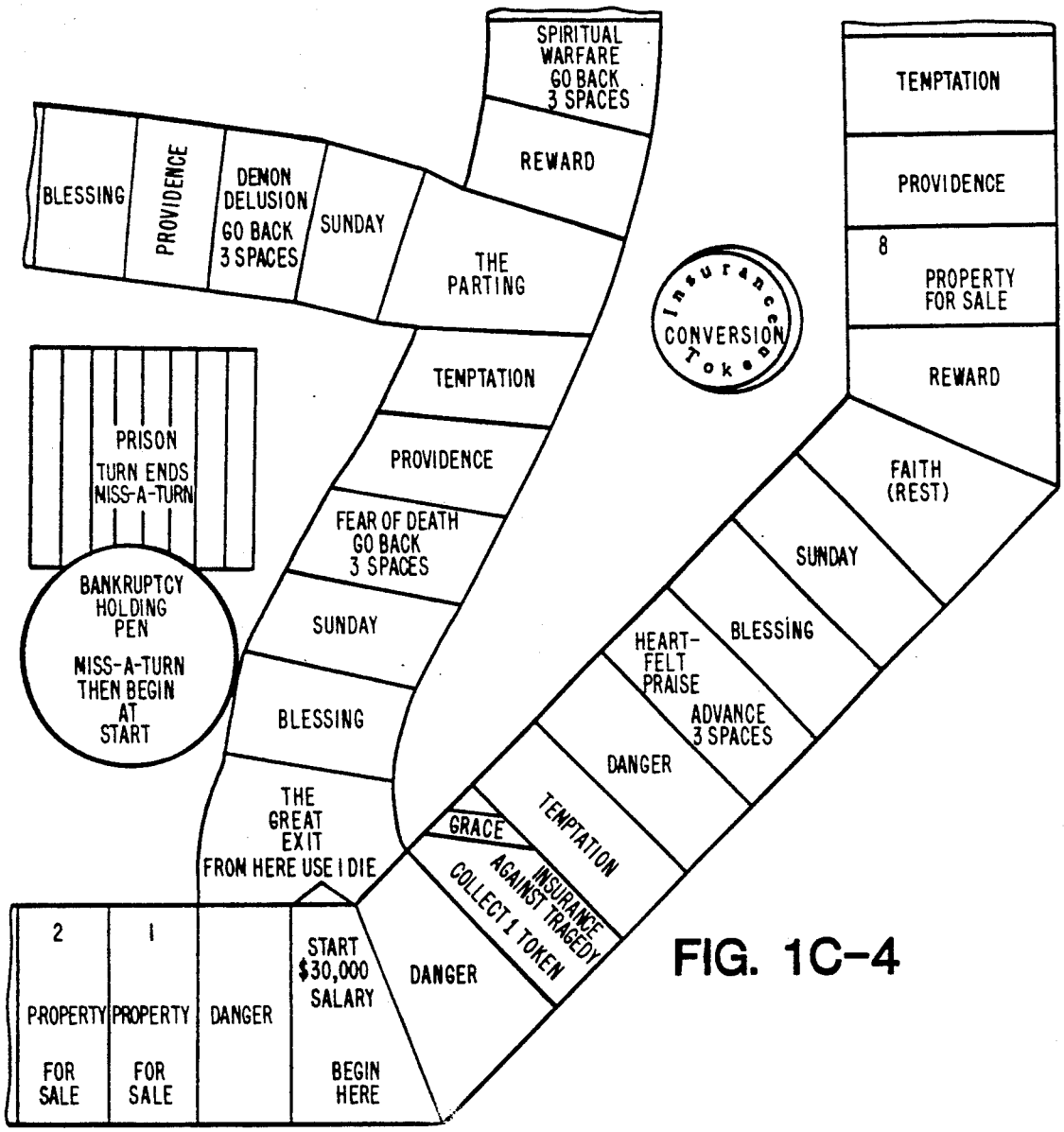

Peg board with sticks—referring to FIG. 1A, the peg board 4 is a block of wood or hollow plastic two inches wide, four inches long, and one inch thick. On the surface and along one length of the board are drilled ten holes, each representing one year, into which small pegs (toothpick size) may be placed. The holes are not drilled completely through. These are for the "age sticks" 1 which are toothpicks, or similar-sized wood or plastic sticks which fit into the holes. Five additional holes, each of which represents ten years, are drilled in another row next to and parallel to the above-described row of ten holes. Players having ten pegs in the first ten holes may remove them and simply put one peg in the second row of holes which represent ten years each. It is not likely that the game will be played past fifty years. Down the other side of the peg board[4] are drilled three larger holes into which "danger sticks" 2 may be placed. Danger sticks[2] are three inch long wooden sticks or solid plastic bars approximately the size of drinking "stir sticks." Above these holes is written "Danger Sticks." Each danger stick hole is designated by one of the following phrases, from top to bottom: "Sick, miss a turn:" "Hospital, miss 2 turns:" and "Dying." with no two holes sharing the same phrase.

Property deeds—property deeds 95 are made from red or bright colored cover stock with the words such as. "Property Deed #6, Rent $15,000," and are seven-eighths inch wide and three inches long. There is one property deed for each of the "Property" spaces on the board. When laid over a property space, a property deed will indicate that the property represented by the space has been "purchased" by a player, as explained in the explanation below of playing the game.

Insurance tokens—insurance tokens 80 are round flat aluminum, wood or plastic pieces one inch in diameter with the words: "Conversion. Insurance Token" printed or embossed upon each side. Pennies may be used as substitutes.

Miss-a-turn sticks—"Miss-a-turn" sticks[3] are two inch plastic sticks of approximately the same width and shape as drinking stir sticks and with the words. "Miss-a-turn" printed or embossed upon them.

Asset Sheet and End-of-Life Tally Sheet—referring to FIG. 1B. the "Asset Sheet" 5 is a sheet of paper four and one half by six inches with a double column of lines upon which to keep up with cash on hand. At the top of each sheet is written: "Conversion," "Asset Sheet," "Income, $30,000 (begin)". Near the bottom are places to keep up with property and investments which are obtained by the player during the game. The "End of Life Tally for the Converted" Sheet 6 is a sheet of paper three and one half by four inches, containing the following information: cash on hand, value of reward cards, value of investments, value of property, value of age sticks, less negative reward cards, and less twice the value of any sin cards. The "End of Life Tally for the Unconverted" sheet 7 is a sheet of paper which is similar to the "End of Life Tally for the Converted" sheet except that it subtracts from the asset values five thousand dollars for each age stick and does not allow any favorable reward cards to be included in the asset totals. Each game is provided with a pad of "Asset Sheets," a pad of "End of Life Tally for the Converted" sheets, and a pad of "End of Life Tally for the Unconverted, sheets, each pad containing approximately thirty sheets.

Dice—one set of dice 85 (consisting of two dice) is included.

Instructions—one set of written instructions is included.

Playing the Game

At the commencement of the game, each set of cards is placed face downward on its corresponding rectangle, and each player selects a player piece which is placed on the "Start" space.[25] Each player also receives an "Asset Sheet"[5] and is allotted $30,000, which is reflected as the first entry printed on the "Income" column of each Asset Sheet.[25]

The game begins with each of the players throwing dice to determine who will move first. The player who rolls the highest total goes first. If two or more players roll the same highest number, these players roll again until only one player has the highest number. Players who roll doubles continue to roll until they cease to roll a double. After the first player is chosen, the turns of the remaining players are determined in accordance with their position around the board, going clockwise beginning with the player to the immediate left of the first player.

Each player begins the game "unconverted" and moves his player piece (crown end down) around the board with each throw of the dice, moving counterclockwise unless or until he is "converted." which can occur only upon landing on a "Sunday" space. Upon landing on a "Sunday" space, the player throws the dice again. If the player throws an even number of the dice, he remains "unconverted" and continues to move his player piece counterclockwise. If the player throws an odd number on the dice, he becomes "converted," inverts his player piece so that the crown end is up (indicating that he is now a "new creature in Christ"), and throws the dice again, moving in a clockwise direction for the rest of the game. Once converted a player can never become unconverted. A roll of doubles on the dice allows the player to move and to roll again unless otherwise prevented (e.g., by landing on a "Danger" space).

As players will, at times, move in different directions, confusion may result. If at any time a player accidentally moves his own player piece in the wrong direction or another player's piece in any direction, any other player can alert everyone else to such error the instant such player takes his hand off the playing piece. If the player in error is unconverted, the word to shout to alert everyone else is "pretender." If the player in error is converted, the word to shout to alert everyone else is "backslider." The player who notes such error by calling the correct word collects ten thousand dollars from the player in error, noted by an increase of $10,000 on the Asset Sheet[5] of the player who noted the error and a decrease of $10,000 on the Asset Sheet[5] of the player who made the error. Any time a player lands on the same space as another player who is going in the opposite direction, the former undergoes a "trial". The player on trial rolls the dice to determine the outcome of the trial. An even numbered roll means that the player on trial must pay ten thousand dollars to the other player or to each of the other players on that space who are going in the opposite direction, and an odd numbered roll means the player on trial collects ten thousand dollars from each of the other players on that space who are going in the opposite direction. These payments are recorded on the Asset Sheets[5] of the respective players as noted above. In the event the trial happens on a "Sunday" space, the player on trial rolls for the trial first and then to attempt conversion.

The age sticks[1] represent the number of years the player has been in the game. Each player puts an age stick[1] in a one-year hole of his peg board[4] each time he passes or lands on the "Start" space, at which point the player earns an annual salary of thirty thousand dollars which is entered on the player's Asset Sheet.[5] The player, in order to receive the salary, must collect the sum prior to the next player's completing his turn (moving his "man") or the salary will be forfeited (along with the age stick for that "year"). Once ten sticks have been inserted by the player in the one-year holes on the board, these sticks are removed and a single stick is placed into a ten-year hole, and the player once again begins to fill the one-year holes. At the end of the game, each year that the player has been in the game is worth five thousand dollars, as recorded on the player's End of Life Tally sheet.[6]

The peg board[4] also is constructed to hold up to three danger sticks,[2] one of which is inserted into a "danger stick" hole on the board each time a player lands on a "Danger" space. The first time a player lands on a "Danger" space, he is considered "sick," loses one turn, and places a danger stick[2] in the hole on the peg board designated "Sick, miss a turn." The second time a player lands on a "Danger" space, the player is "hospitalized," misses two turns, and places another danger stick[2] in the hole on the peg board designated "Hospital, miss 2 turns." After the player lands on a danger space a third time, the player is considered to be "dying" and places a stick[2] in the "Dying" hole on the peg board,[4] but is allowed to continue to play without missing a turn this time until he reaches the "The Great Exit" space[30] where he must exit up into the center of the board rather than proceeding to the "Start" space.[25] To aid each player in remembering how many turns he must miss, the player takes one miss-a-turn stick[3] for each turn he is to miss, which he must place in a prominent place in front of him next to the board. As each missed turn passes, the player returns one stick to the stock of unheld sticks. Even if doubles are thrown by a player, the landing on a "Danger" space by the player results in the player losing his turn.

Once a player has proceeded to or beyond "The Great Exit" space,[30] the player uses only one of the two dice. If the player is "unconverted." he must travel towards the "Eternal Loss" space[40] at which point he has lost the game. If the player is "converted", he continues towards "Eternal Happiness"[45] at which time the game is over for the converted player. A player can enter "Eternal Loss"[40] or "Eternal Happiness"[45] only upon an exact roll of the die. Even after landing on or passing the "The Great Exit"space,[30] there are opportunities for a player to be "healed" by landing upon either a "Providence" space or "Blessing" space and drawing a "Providence" card or "Blessing" card that instructs the player to remove one danger stick from the peg board. Upon drawing such a card, the player turns around and goes back down the spaces on his next and subsequent turns and collects thirty thousand dollars as he passes "The Great Exit" space,[30] proceeding clockwise on the outside spaces if "converted" or counterclockwise if "unconverted."

The game board has ten "Temptation" spaces. Upon landing on a "Temptation" space, the player throws one die. An even numbered throw means the player yielded to the temptation and must draw a "Sin Card" which instructs the player of his penalty. For example, some cards will instruct the player to go to prison.[70] All prison terms cause the player to miss one turn. When that player's turn comes up again, his player piece is moved to the "Start" space,[25] he is credited with a $30,000 salary and an age stick[1] as though he had landed on the "Start" space[25]by the usual means of moving his player piece, and he continues in the same direction as before he went to prison. An odd numbered throw of the die means the player resisted the temptation and no further action is required. Sin Cards are kept by the player until the end of the game unless the player is converted or draws a Blessing Card which instructs the player to replace the Sin Card in the deck, in either of which event the player returns his Sin Cards to the bottom of the Sin Card deck, face up. When all the cards in the deck have been drawn, the deck is re-shuffled and returned to its rectangle face down. Sin cards held at the end of the game are counted as a penalty against the player, as discussed below with regard to computing the End of Life Tally.

There are eight "Property" spaces on the game board. Anytime a player lands on a "Property" space that has not been previously "purchased," the player has the option of purchasing that property space for fifty thousand dollars. Upon the purchase thereof, the purchaser places a property deed next to (or sightly overlapping) the related "Property" space to alert the other players that the property is for rent and records the number of the property on his Asset Sheet. Each of the other players must pay rent of fifteen thousand dollars each time he lands on that Property space. In the event a player needs to sell the property, he may "sell" it to the "imaginary" bank at a price thirty percent less than the price he paid for it or he can sell it to any other player at any agreed upon price.

In addition to the eight "Property" spaces, the game board has two "Investment Opportunity" spaces. These spaces offer the player the option to invest five thousand dollars which doubles in value with every "year" that is credited to the player (each time that the player passes or lands on the "Start" space and receives an age stick that is not otherwise forfeited). The player notes the year he makes such investment on his Asset Sheet. If the investment is made during the first year, the player records a "0" as the year it was purchased, and its value becomes ten thousand dollars when the player receives his first age stick after purchasing the property. The value doubles again to twenty thousand dollars when the player receives his second age stick, and so on. Only one investment is allowed per player except that investments may be bought from other players at any agreed upon price, which becomes the basis for subsequent increases in value (doubling each year) as described above. A player can also sell any investment back to the bank at half its current value which is determined by doubling for each year it has been owned.

If a player cannot pay a debt for lack of assets, he is deemed to be bankrupt, and he must move his player piece to the "Bankruptcy Holding Pen"[75] and lose one turn. Before declaring bankruptcy, the player must pay or transfer whatever assets he has to the player or players to whom he owes the debt, if necessary selling all his property and investments as described above. The amount of debt that the player cannot pay is cancelled. After missing a turn, the bankrupt player must start play over again at the "Start" space[25] with only thirty thousand dollars but retains his age sticks.

There are nine "Providence" spaces on the game board. When a player lands on a "Providence" space, he draws a "Providence Card" which provides any of a number of sets of instructions to the player which may be favorable or unfavorable but which, in any event, the player must follow. The Providence Card is then returned to the bottom of the Providence Card deck, face up. When all the cards in the deck have been drawn, the deck is reshuffled and returned to its rectangle face down.

Blessing Cards are drawn only by converted players who land on one of the nine "Blessing" spaces and are disregarded by unconverted players. Each Blessing Card provides favorable instructions or rewards to the player who draws it. The Blessing Card is then returned to the bottom of the Blessing Card deck, face up. When all the cards in the deck have been drawn, the deck is re-shuffled and returned to its rectangle face down.

The fourth and final set of cards is the set of Reward Cards, which are drawn only by converted players who land on any one of the eight "Reward" spaces. Reward Cards are not drawn by unconverted players. A player retains all Reward Cards drawn by him and are taken into account only at the end of the game when computing the End of Life Tally of the player. A Reward Card may be either favorable or unfavorable; however, negative Reward Cards may be cancelled by drawing proper Blessing or Providence Cards, and good Reward Cards may be lost by landing on "Offended" or "Backslidden" spaces, which call for the loss of one good reward.

There is one "Tragedy" space. When the player lands on the "Tragedy" space, he immediately forfeits all assets that he has accumulated (i.e.. cash, property and investments), his turn ends, and be begins at the "Start" space with only thirty thousand dollars but retains his age sticks. Tokens of insurance against tragedy can be collected to wholly or partially avoid tragedy by landing on any one of the three "Insurance Against Tragedy" spaces. One token is collected by a player each time he lands on an "Insurance Against Tragedy" space, but no more than three tokens may be held by a player at any one time. When a player lands on the "Tragedy" space, he can use each token that he has collected to protect either his cash, property, or investments, but no more than one of those three types of assets per token. If the player has three tokens, this would completely prevent a tragedy.

The other spaces on the board include seven "Advance Three Spaces" spaces, eight "Go Back Three Spaces" spaces, one "Vacation, skip 1 turn" space, and two spaces which call for no action by players, which are the "Faith (Rest)" space and the "Repentance (Relief)" space.

The game ends when the last player to land on "Eternal Happiness"[45] or "Eternal Loss"[40] lands on either of those two spaces. Upon reaching either of these places, each player totals up his assets on an End of Life Tally sheet[6] ("converted" or "unconverted" tally sheet as is appropriate). The winner is the converted player who has the most total assets at the end of the game, which is cash on hand, value of investments, any benefits provided by Reward Cards, full property values of fifty thousand dollars each, five thousand dollars for each age stick, and less any penalties imposed by negative Reward Cards and a double penalty for all Sin Cards on hand. If no player is converted, there is no winner. An End of Life Tally for the unconverted[7] has no effect on the determination of the winner but is provided for amusement. The Tally for an unconverted player is computed as follows: the sum of cash on hand, full property values of fifty thousand dollars each, and value of investments, but less five thousand dollars for each age stick and a double penalty for each Sin Card on hand.

Conversion offers the opportunity of continuous play. When a player dies, he may start over as a different player and begin playing again. Such individual shall continue until his new piece "dies" or until the "death" of the last of the original players. The last player's death is symbolically perceived as the coming of Christ and forces the end of all play. At such time, all players cease play and total their assets. Because of the tragedies and variables involved in the game, it is possible for a new player or late beginner to end up the winner.

Because many varying and different embodiments may be made within the scope of the inventive concept taught herein (including the use of the concepts taught and devised herein for a secular or video version of the game) which may involve many modifications in the embodiments herein detailed in accordance with the descriptive requirements of the law, it is to be understood that the details herein are to be interpreted as illustrative and not in a limiting sense.

What is claimed as an invention:

1. A board game, comprising:

a board having a playing path divided into a plurality of spaces containing designators designated for secular and biblical activities;

playing pieces adapted to set on said spaces of said board in two orientations;

a random selector having several numerical values divided into at least two sets of values whereby the movement of said playing pieces on said board is regulated;

teaching means associated with said board for teaching biblical principles;

wherein several of said spaces are designated: "Sunday" and each of said playing pieces commences movement on said playing path in a first direction and a first orientation and each of said playing pieces continues movement as regulated by said random selector until said playing piece lands on said "Sunday" space while the numerical value is within said first set of values and said playing piece is then inverted to a second orientation and permanently moves in a second direction reverse to said first direction along said playing path thereafter.

2. The board games as recited in claim 1, wherein there is included four rectangles designated as follows: "Sin Cards," "Providence Cards,""Blessing Cards," and "Reward Cards," said rectangles being located on said board and in which contains four sets of cards which corresponds to said four rectangles and said cards being designated "Sin Cards," "Providence Cards," "Blessing Cards," and "Reward Cards," and wherein each of the four sets of cards have Biblical excerpts imprinted thereon and contain legends, the movement of said playing pieces being determined by the statement on said cards upon a card being picked.

3. The board game of claim 1, wherein one of said spaces is designated "The Parting" and wherein said playing piece upon reaching said "The Parting" space, branches in two directions dependant on the direction of movement of said playing piece around said board.

4. The board game of claim 3, wherein one of said spaces is designated "Eternal Loss" and the first of said two directions culminates at said "Eternal Loss" terminating play for said playing piece as a loss.

5. The board game of claim 3, wherein one of said spaces is designated "Home—Eternal Happiness" and the second of said directions culminates at said "Home—Eternal Happiness" terminating play for said playing piece and a chance to win the game.

6. The board game of claim 3, wherein the game ends when all of said playing pieces reaches the end space of either of said two directions.

7. The board game of claim 6, wherein the players may select new playing pieces and continue to play prior to said end of said game.

8. The board game of claim 1, wherein said spaces are on the periphery and interior of said board and one of said spaces is entitled "The Great Exit" connecting said interior and periphery spaces.

9. A board game, comprising:

a board having spaces containing designators designated for secular and biblical activities on the periphery and interior of said board, one of said spaces entitled "The Great Exit" connecting said periphery with said interior spaces;

playing pieces adapted to set on said spaces of said board;

a random selectors having several numerical values whereby the movement of said playing pieces on said board is regulated;

teaching means associated with said board for teaching biblical principles;

wherein there is further included a peg board, said peg board includes three large holes which are entitled from top to bottom: "Sick, miss a turn;" "Hospital, miss 2 turns;" and "Dying" and wherein there are included danger sticks, said danger sticks having means for insertion into said three larger holes of said peg board and wherein said spaces on said board includes spaces marked "Danger", said playing pieces landing on said "Danger" spaces causing said danger sticks to be inserted into said large holes of said peg board from said top to said bottom consecutively with the number of times and "Danger" space is reached, and said playing piece missing one and two turns respectively for the first and second of said landings and said playing piece moving from said "The Great Exit" space to said interior board spaces after said third landing of said "Danger" space.

* * * * *